US007362996B2

(12) United States Patent
Facci et al.

(10) Patent No.: US 7,362,996 B2
(45) Date of Patent: Apr. 22, 2008

(54) CLEANING AND SPOTS BLADE LUBRICATING METHOD AND APPARATUS

(75) Inventors: John S. Facci, Webster, NY (US); William H. Wayman, Ontario, NY (US); Michael Q. Lu, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 330 days.

(21) Appl. No.: 11/182,974

(22) Filed: Jul. 14, 2005

(65) Prior Publication Data

US 2007/0014605 A1 Jan. 18, 2007

(51) Int. Cl.
*G03G 21/00* (2006.01)

(52) U.S. Cl. ..... 399/346; 399/350

(58) Field of Classification Search ..... 399/343, 399/344, 345, 346, 350; 15/1.51, 256.5; 427/145, 180, 430.1; 430/125
See application file for complete search history.

(56) References Cited

U.S. PATENT DOCUMENTS

| | | | | |
|---|---|---|---|---|
| 3,590,000 | A | 6/1971 | Palermiti et al. | |
| 3,983,045 | A | 9/1976 | Jugle et al. | |
| 4,158,498 | A | 6/1979 | Ohmori | |
| 5,463,455 | A | 10/1995 | Pozniakas et al. | |
| 5,463,456 | A | 10/1995 | Yashiki et al. | |
| 6,060,205 | A * | 5/2000 | Takeichi et al. | 430/126.2 |
| 6,775,512 | B2 | 8/2004 | Thayer | |
| 6,987,943 | B2 * | 1/2006 | Ito | 399/350 |
| 7,043,188 | B2 * | 5/2006 | Curynski et al. | 399/346 |
| 2007/0140720 | A1 * | 6/2007 | Lu et al. | 399/71 |

FOREIGN PATENT DOCUMENTS

| | | |
|---|---|---|
| JP | 5-313457 | * 11/1993 |
| JP | 2002-311764 | * 10/2002 |

* cited by examiner

*Primary Examiner*—Hoan Tran
(74) *Attorney, Agent, or Firm*—Tallam I. Nguti

(57) ABSTRACT

A cleaning and spots blade lubricating apparatus and method, the apparatus for the method includes (a) a pre-clean charging device including a first bias having a first polarity; (b) a cleaning device having (1) a cleaning mode including a second bias having a second polarity opposite the first polarity, and (ii) a non cleaning mode including a third bias having a third polarity; (c) a spots blade for removing random spots from a moving photoreceptor surface being cleaned; and (d) a programmable controller connected to the pre-clean charging device and to the cleaning device for forming a lubricating residual toner stripe on a portion of the moving photoreceptor surface, the programmable controller intermittently and momentarily switching the cleaning device from the cleaning mode to the non-cleaning mode for forming the lubricating residual toner stripe.

20 Claims, 3 Drawing Sheets

CLEANING AND SPOTS BLADE LUBRICATING METHOD AND APPARATUS

CROSS-REFERENCE TO RELATED APPLICATIONS (NOT APPLICABLE)

BACKGROUND OF THE INVENTION

The present disclosure relates generally to electrostatographic reproduction machines, and more particularly, concerns such a machine including a cleaning and spots blade lubricating method and apparatus.

In a typical toner image reproduction machine, for example an electrostatographic printing process machine, an imaging region of a toner image bearing member such as a photoconductive member is charged to a substantially uniform potential so as to sensitize the surface thereof. The charged portion of the photoconductive member is irradiated or exposed to a light image of an original document being reproduced. Exposure of the charged photoconductive member selectively dissipates the charges thereon in the irradiated areas. This records an electrostatic latent image on the photoconductive member corresponding to the informational areas contained within the original document.

After the electrostatic latent image is recorded on the photoconductive member, the latent image is developed by bringing a developer material into contact therewith. Generally, the developer material comprises toner particles adhering triboelectrically to carrier granules. The toner particles are attracted from the carrier granules to the latent image forming a toner powder image on the photoconductive member. The toner powder image is then transferred from the photoconductive member to a copy sheet. The toner particles are heated to permanently affix the powder image to the copy sheet. Residual toner particles remaining on the photoconductive surface following image transfer as above are then removed by a cleaning apparatus in order to prepare the surface for forming another toner image.

The foregoing generally describes a typical black and white electrostatographic printing machine. With the advent of multicolor electrophotography, it is desirable to use an image-on-image architecture that comprises a plurality of image forming stations. One example of the plural image forming station architecture utilizes an image-on-image (IOI) system in that the photoreceptive member is recharged, re-imaged and developed for each color separation. This charging, imaging, developing and recharging, re-imaging and developing, all followed by transfer to paper, is done in a single revolution of the photoreceptor in so-called single pass machines, while multi-pass architectures form each color separation with a single charge, image and develop, with separate transfer operations for each color. Again as above, residual toner particles remaining on the photoconductive surface following image transfer as above are then removed by a cleaning apparatus in order to prepare the surface for forming another toner image.

It has been found that image-on-image processes, for example, create very high toner densities on the photoconductive or photoconductive surface. In some machines using toner particles with toner additives in similar multi-color processes, the additional use of control patches, and engagements in component-disturbing activities such as recovery from paper jams, together create conditions that make cleaning or removal of residual toner particles from the imaging region as well as elsewhere very challenging for ordinary conventional cleaning apparatus. In addition, cleaning devices, for example, urethane rubber blades for cleaning the image forming or carrying surface after each use will tend to scratch and abrade the image forming surface where there is insufficient lubrication at the interface between the blade and the image forming surface. Thus it is well known that the image forming surface must be sufficiently lubricated because lack of sufficient lubrication to the edges of such blades may and usually results in scratching and abrasion of the image forming surface. Such scratches and abrasions could rise to a level where they become printable and hence detrimentally affect the image quality. The situation is made worse when such conditions are combined with demands for higher process speeds, as well as demands for higher print quality, longer component lives and higher machine reliability.

The following references disclose examples of existing surface cleaning and treating devices. U.S. Pat. No. 6,775,512 issued Aug. 10, 2004 and entitled "Dual electrostatic brush cleaner bias switching for multiple pass cleaning of high density toner inputs" discloses apparatus for removing charged particles from a surface, the surface being capable of movement, including: a preclean corotron having a first polarity; and a first cleaning brush for cleaning charged particles from the surface, having a second polarity different from the first polarity of the preclean corotron; a second cleaning brush for cleaning the charged particles from the surface, having a predefined polarity, the second cleaning brush being located downstream from the first cleaning brush, in the direction of motion of the surface; and a controller for changing the predefined polarity of the second cleaning brush from the first polarity to the second polarity.

U.S. Pat. No. 4,158,498 issued Jun. 19, 1979 and entitled "Blade cleaning system for a reproducing apparatus" discloses a reproducing apparatus that includes a blade cleaning system for removing residual material from an imaging surface. The blade is arranged for movement between a first position wherein an edge thereof engages the imaging surface to remove the residual material, and a second position wherein the edge is spaced from the imaging surface. Responsive to a movement of the blade to the second position a device is provided for removing residual material from the blade edge. A supply of lubricating agent is stored in a suitable container arranged above the device for cleaning the blade edge. A dispensing system is responsive to engagement between the blade and the blade edge cleaning device for dispensing a desired amount of lubricating agent onto the blade edge.

U.S. Pat. No. 5,463,455 issued Oct. 31, 1995 and entitled "Method and apparatus for adaptive cleaner blade lubrication" discloses an adaptive cleaner blade lubricating system for electrophotographic printing machines. In an electrophotographic printing machine, the amount of residual toner available to lubricate a cleaner blade is calculated based on the density of the transferred image. A band of toner is deposited in an inner document gap in selective widths so as to provide an adequate amount of toner to lubricate the cleaner blade across the full width of the photoreceptor. The lubricating band may be variable or may be a constant width with the frequency of placement of the band determined based on average image density for a group of documents. In the preferred embodiment, the width of the toner band is varied as a function of the overall residual toner in each pixel location across the width of the photoreceptor based on the density of the images transferred. As a result of the varying lubrication bands, the cleaner blade is maintained so as to not tuck and cause streaking and/or damage while toner efficiency is maximized.

U.S. Pat. No. 3,983,045 issued Sep. 28, 1976 discloses a developer composition comprising (1) electroscopic toner particles (2) a friction-reducing material of a hardness less than said toner and having greater friction-reducing characteristics than said toner material, and (3) a finely divided non-smearable abrasive material of a hardness greater than said friction-reducing and toner materials. An imaging and development process utilizing the above-identified composition including the step of maintaining the buildup of friction-reducing material on an imaging surface in the submicron range without completely removing or preventing said buildup, by the combined action of a cleaning force wiping at least any residual developed image from at least a portion of said imaging surface.

U.S. Pat. No. 5,463,456 issued Oct. 31, 1995 discloses a photosensitive drum unit for an electrophotographic apparatus, of the type of contacting a cleaning blade to the photosensitive drum in which a cleaning assistant composed of a lubricant capable of lowering the frictionally charged potential of the photosensitive drum caused by the friction of the photosensitive drum and the cleaning blade to not higher than 100 V is attached to the surface of the photosensitive drum, the cleaning blade or both.

U.S. Pat. No. 3,590,000 issued Jun. 29, 1971 discloses a toner with a lubricant additive described as a finely divided, rapid melting toner comprising a colorant, a solid, stable hydrophobic metal salt of fatty acid, a polymeric esterification product of dicarboxylic acid and a diol comprising diphenol.

BRIEF SUMMARY OF THE INVENTION

In accordance with one aspect of the present disclosure, there is provided a cleaning and spots blade lubricating apparatus and method, the apparatus for the method comprising (a) a pre-clean charging device including a first bias having a first polarity; (b) a cleaning device having (i) a cleaning mode including a second bias having a second polarity opposite the first polarity, and (ii) a non cleaning mode including a third bias having a third polarity; (c) a spots blade for removing random spots from a moving photoreceptor surface being cleaned; and (d) a programmable controller connected to the pre-clean charging device and to the cleaning device for forming a lubricating residual toner stripe on a portion of the moving photoreceptor surface, the programmable controller intermittently and momentarily switching the cleaning device from the cleaning mode to the non-cleaning mode for forming the lubricating residual toner stripe.

BRIEF DESCRIPTION OF THE DRAWINGS

The foregoing and other features of the instant disclosure will be apparent and easily understood from a further reading of the specification, claims and by reference to the accompanying drawings in that:

DETAILED DESCRIPTION OF THE INVENTION

While the present disclosure will be described hereinafter in connection with a preferred embodiment thereof, it should be understood that it is not intended to limit the disclosure to that embodiment. On the contrary, it is intended to cover all alternatives, modifications and equivalents as may be included within the spirit and scope of the disclosure as defined in the appended claims.

Figure 1:
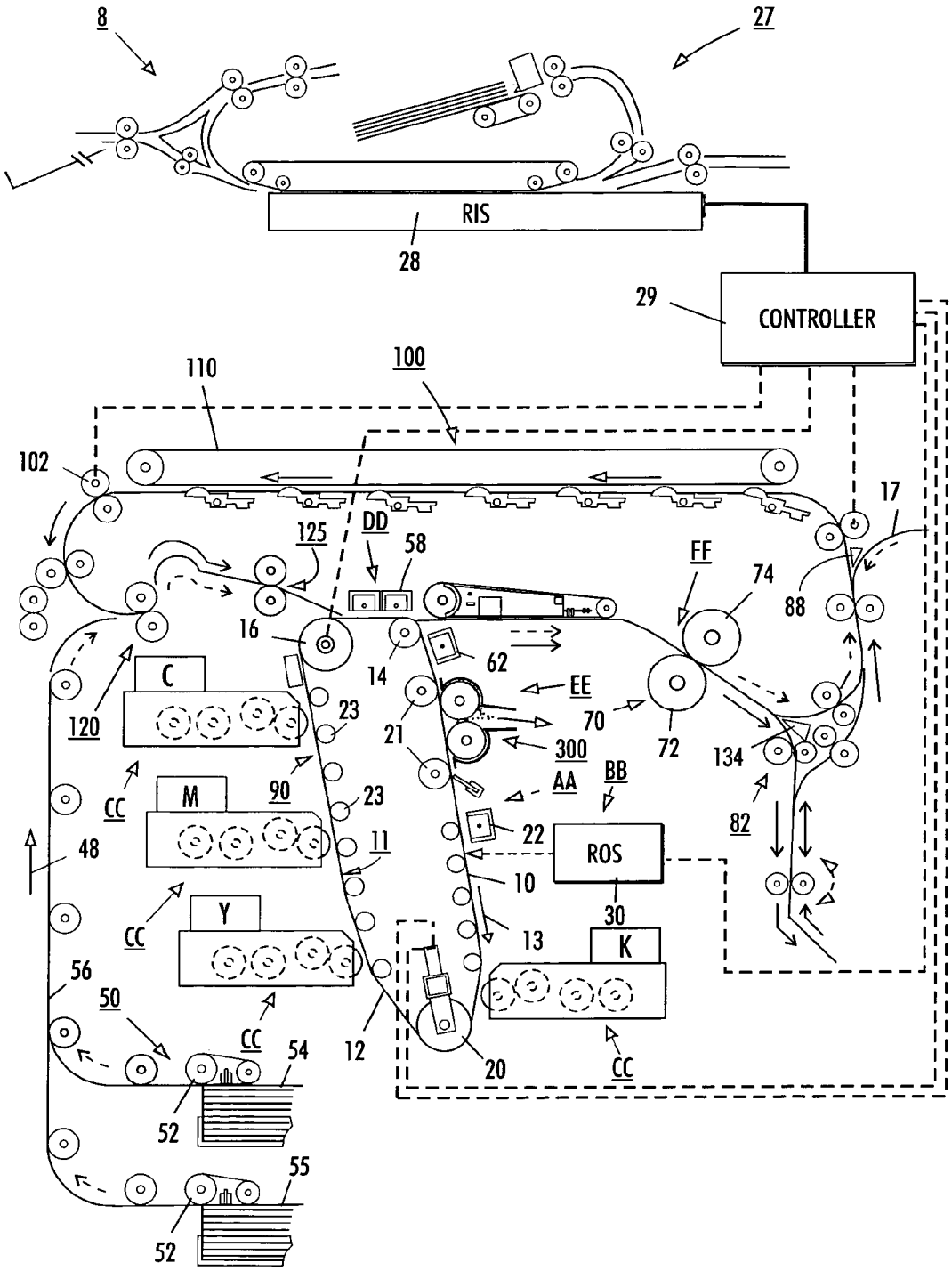
FIG. 1 is a schematic elevational view of an exemplary electrostatographic reproduction machine depicting the cleaning and spots blade lubricating apparatus for the method of the present disclosure.
Figure 2:
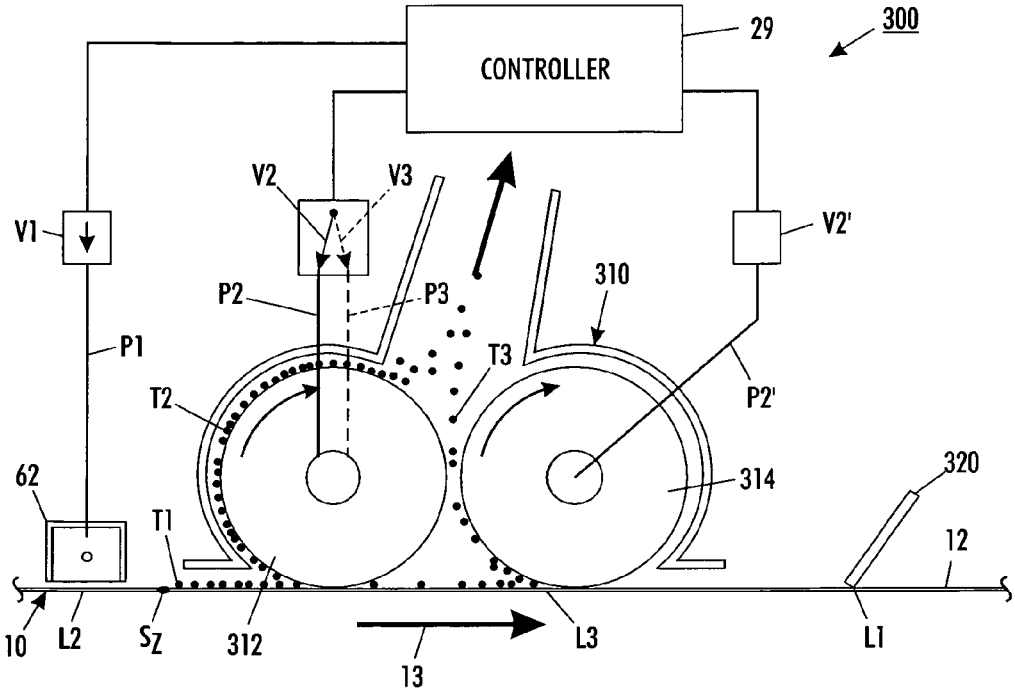
FIG. 2 is an enlarged illustration of the cleaning and spots blade lubricating apparatus in the present disclosure in a cleaning mode.
Figure 3:
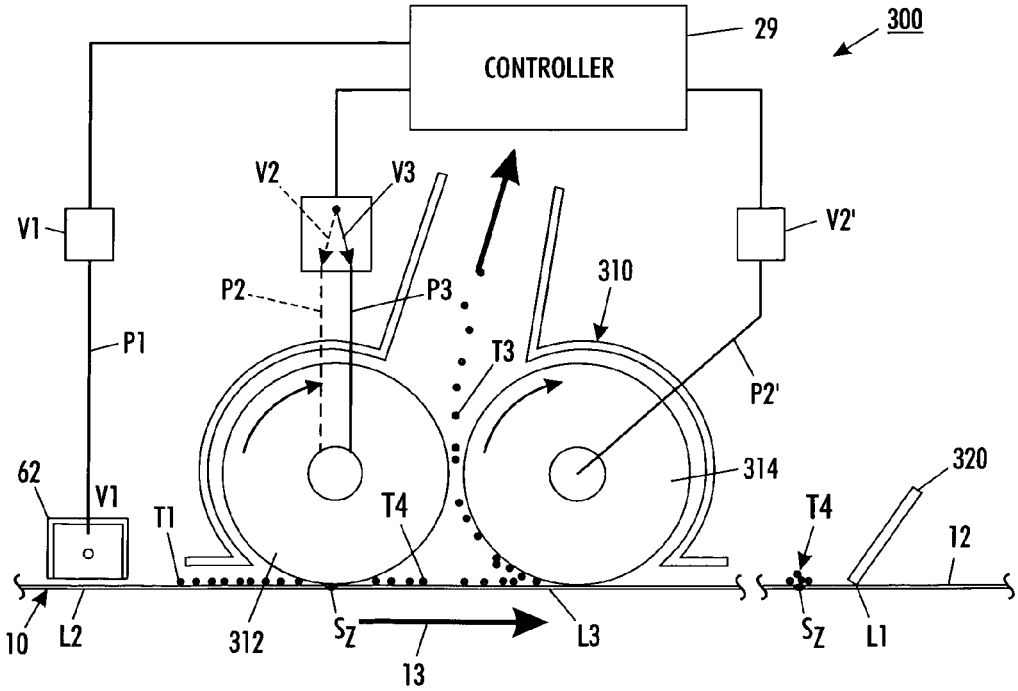
FIG. 3 is an enlarged illustration of the cleaning and spots blade lubricating apparatus of FIG. 2 following formation of a lubricating toner stripe in accordance with the present disclosure.

Referring first to FIG. 1, it schematically illustrates an electrostatographic reproduction machine 8 that generally employs a photoconductive belt 10 mounted on a belt support module 90. Preferably, the photoconductive belt 10 is made from a photoconductive material coated on a conductive grounding layer that, in turn, is coated on an anti-curl backing layer. Belt 10 moves in the direction of arrow 13 to advance successive portions sequentially through various processing stations disposed about the path of movement thereof. Belt 10 is entrained as a closed loop 11 about stripping roll 14, drive roll 16, idler roll 21, and backer rolls 23.

Initially, a portion of the photoconductive belt surface passes through charging station AA. At charging station AA, a corona-generating device indicated generally by the reference numeral 22 charges the photoconductive belt 10 to a relatively high, substantially uniform potential.

As also shown the reproduction machine 8 includes a controller or electronic control subsystem (ESS) 29 that is preferably a self-contained, dedicated minicomputer having a central processor unit (CPU), electronic storage, and a display or user interface (UI). The ESS 29, with the help of sensors and connections, can read, capture, prepare and process image data and machine status information.

Still referring to FIG. 1, at an exposure station BB, the controller or electronic subsystem (ESS), 29, receives the image signals from RIS 28 representing the desired output image and processes these signals to convert them to a continuous tone or gray scale rendition of the image that is transmitted to a modulated output generator, for example the raster output scanner (ROS), indicated generally by reference numeral 30. The image signals transmitted to ESS 29 may originate from RIS 28 as described above or from a computer, thereby enabling the electrostatographic reproduction machine 8 to serve as a remotely located printer for one or more computers. Alternatively, the printer may serve as a dedicated printer for a high-speed computer. The signals from ESS 29, corresponding to the continuous tone image desired to be reproduced by the reproduction machine, are transmitted to ROS 30.

ROS 30 includes a laser with rotating polygon mirror blocks. Preferably a nine-facet polygon is used. At exposure station BB, the ROS 30 illuminates the charged portion on the surface of photoconductive belt 10 at a resolution of about 300 or more pixels per inch. The ROS will expose the photoconductive belt 10 to record an electrostatic latent image thereon corresponding to the continuous tone image received from ESS 29. As an alternative, ROS 30 may employ a linear array of light emitting diodes (LEDs)

arranged to illuminate the charged portion of photoconductive belt 10 on a raster-by-raster basis.

After the electrostatic latent image has been recorded on photoconductive surface 12, belt 10 advances the latent image through development stations CC, that include four developer units as shown, containing CMYK color toners, in the form of dry particles. At each developer unit the toner particles are appropriately attracted electrostatically to the latent image using commonly known techniques.

With continued reference to FIG. 1, after the electrostatic latent image is developed, the toner powder image present on belt 10 advances to transfer station DD. A print sheet 48 is advanced to the transfer station DD, by a sheet feeding apparatus 50. Sheet-feeding apparatus 50 may include a corrugated vacuum feeder (TCVF) assembly 52 for contacting the uppermost sheet of stack 54, 55. TCVF 52 acquires each top sheet 48 and advances it to vertical transport 56. Vertical transport 56 directs the advancing sheet 48 through feed rolls 120 into registration transport 125, then into image transfer station DD to receive an image from photoreceptor belt 10 in a timed manner. Transfer station DD typically includes a corona-generating device 58 that sprays ions onto the backside of sheet 48. This assists in attracting the toner powder image from photoconductive surface 12 to sheet 48. After transfer, sheet 48 continues to move in the direction of arrow 60 where it is picked up by a pre-fuser transport assembly and forwarded to fusing station FF.

Fusing station FF includes a fuser assembly indicated generally by the reference numeral 70 that permanently affixes the transferred toner powder image to the copy sheet. Preferably, fuser assembly 70 includes a heated fuser roller 72 and a pressure roller 74 with the powder image on the copy sheet contacting fuser roller 72. The pressure roller is urged against the fuser roller to provide the necessary pressure to fix the toner powder image to the copy sheet. The fuser roll is internally heated by a quartz lamp (not shown). Release agent, stored in a reservoir (not shown), is pumped to a metering roll (not shown). A trim blade (not shown) trims off the excess release agent. The release agent is transferred to a donor roll (not shown) and then to the fuser roll 72.

The sheet then passes through fuser 70 where the image is permanently fixed or fused to the sheet. After passing through fuser 70, a gate 88 either allows the sheet to move directly via output 17 to a finisher or stacker, or deflects the sheet into the duplex path 100. Specifically, when the sheet is to be directed into the duplex path 100, it is first passed through a gate 134 into a single sheet inverter 82. That is, if the second sheet is either a simplex sheet, or a completed duplexed sheet having both side one and side two images formed thereon, the sheet will be conveyed via gate 88 directly to output 17. However, if the sheet is being duplexed and is then only printed with a side one image, the gate 88 will be positioned to deflect that sheet into the inverter 82 and into the duplex loop path 100, where that sheet will be inverted and then fed to acceleration nip 102 and belt transports 110, for recirculation back through transfer station DD and fuser 70 for receiving and permanently fixing the side two image to the backside of that duplex sheet, before it exits via exit path 17.

After the print sheet is separated from photoconductive surface 12 of belt 10, the residual toner/developer and paper fiber particles still on and may be adhering to photoconductive surface 12 are then removed therefrom at cleaning station EE in accordance with the present disclosure. Cleaning station EE as illustrated includes the cleaning and spots blade lubricating apparatus 300 of the present disclosure.

Figure 4:
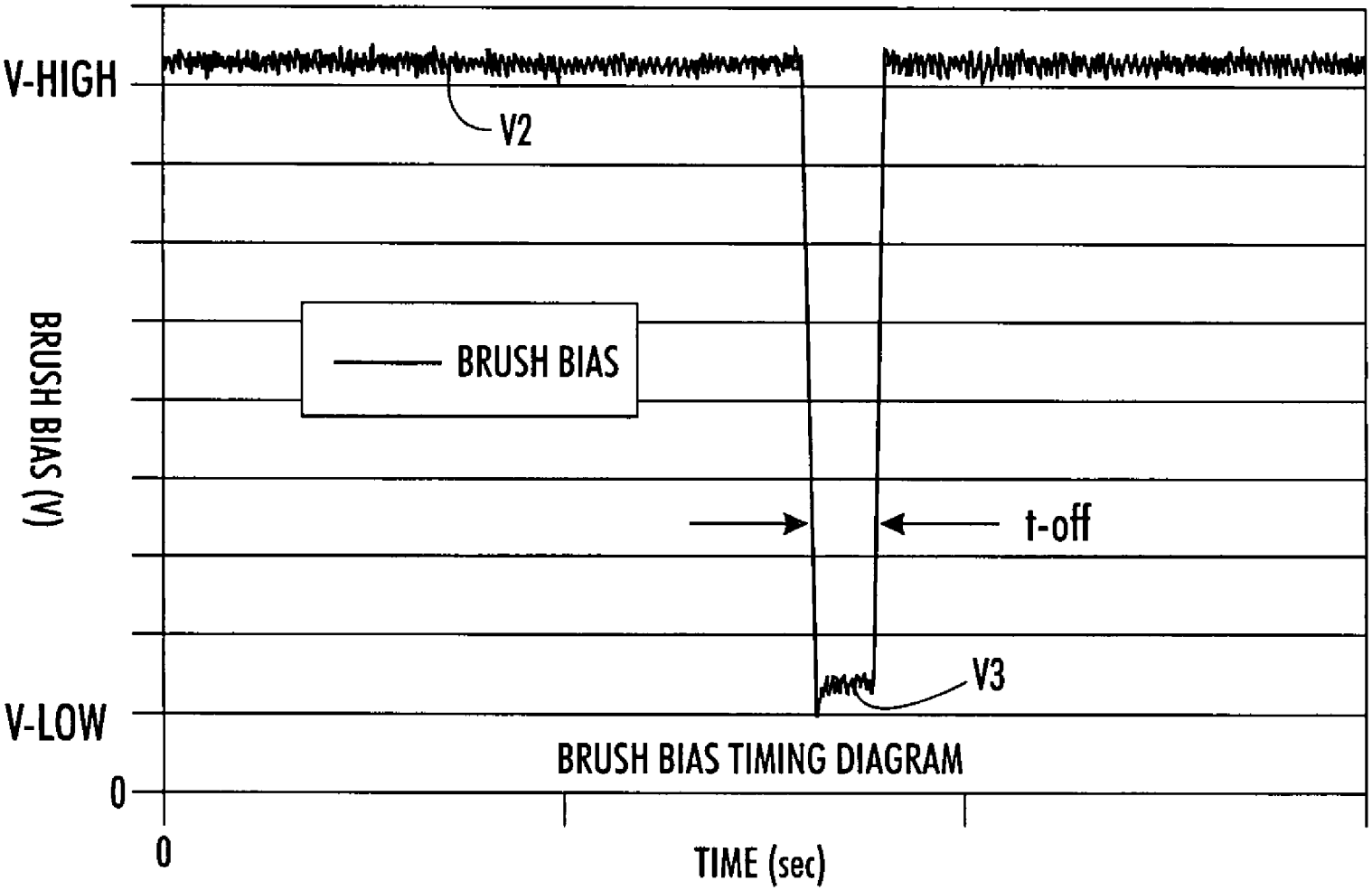
FIG. 4 is a partial illustration of the timing diagram for the cleaning and spots blade lubricating apparatus in accordance with the present disclosure.

Referring now to FIGS. 1-4, the cleaning and spots blade lubricating apparatus 300 for the method of the present disclosure is illustrated in detail, and comprises (a) the pre-clean charging device 62 including the first bias V1 having the first polarity P1 for charging residual toner particles T1 on the moving photoreceptor surface 12; (b) the cleaning device 310 that has (i) a cleaning mode (FIG. 2) including a second switchable bias V2 having a second polarity P2 opposite the first polarity, for removing charged residual toner particles on the photoreceptor surface 12, and (ii) a non cleaning mode FIG. 3) including a third bias V3 having a third polarity P3; (c) the spots blade 320 for removing random spots from the moving photoreceptor surface; and (d) the programmable controller 29 connected to the pre-clean charging device 62 and to the cleaning device 310 for intermittently and momentarily switching the cleaning device from the cleaning mode to the non-cleaning mode for repelling and leaving the lubricating toner stripe T4 on the moving photoreceptor surface upstream of contact with the spots blade 320, thereby intermittently enhancing lubrication of the spots blade and preventing the spots blade from abrading and scratching the moving photoreceptor surface. FIG. 4, is a partial illustration of the timing diagram for controlling the bias V2, V3 on the cleaning device 310.

In accordance with the present disclosure, the pre-cleaning charger 62 comprises a corotron device; the first polarity P1 is a negative polarity, the at least one cleaning device 310 comprises rotatable fiber brushes 312, 314. As shown, the first brush 312 has the switchable bias V2 thereon. The second brush 314 however has a bias V2' thereon and a polarity P2' that is opposite the cleaning polarity P2 on brush 312 for picking up any wrong sign (positive) toner particles T3 that for example are created by the positive cleaning bias V2 on brush 312. On the first brush 312, the second polarity P2 is a positive polarity, and the third polarity P3 is effectively a negative polarity, and can have a bias value from −450V to approximately +60V, and more preferably from) V to −450V. In one embodiment, the programmable controller 29 is programmed to switch the at least one cleaning device 310 from the cleaning first mode to the non-cleaning second mode for a period of time within a range of 100 msec to 150 msec, and in another, it is programmed to switch the at least one cleaning device from the cleaning first mode to the non-cleaning second mode for a period of 125 msec.

The method of lubricating a spots blade with a residual toner particles cleaning apparatus in accordance with the present disclosure includes (a) contacting a moving photoreceptor surface 12 with the spots blade 320 at a first point L1 along a path of movement 13 of the moving photoreceptor surface; (b) charging residual toner particles T1 on the photoreceptor surface 12 to a first polarity P1 at a second point L2 upstream of the first point along the path of movement; (c) operating, in a first cleaning mode, a dual mode cleaning device 310 including a controller 29 and a switchable dual polarity biasing source V2, V3 switched to V2 and a second cleaning polarity P2 for attracting and removing charged residual toner particles T2 from the photoreceptor surface; and (d) momentarily switching the dual polarity biasing source V2, V3 from V2 and the second cleaning polarity P2 to V3 and a third non-cleaning polarity P3 for repelling and leaving a lubricating toner stripe T4 on the moving photoreceptor surface upstream of contact with the spots blade 320, thereby intermittently enhancing lubrication of the spots blade and preventing the spots blade from abrading and scratching the moving photoreceptor surface. The dual mode cleaning device 310 is operated thus at a third point L3 between the first and second points L1, L2 along the path of movement of the moving photoreceptor surface.

As pointed out above, the cleaning and spots blade lubricating apparatus 300 is suitable for forming a lubricating toner stripe T4 upstream of the spots blade 320 by momentarily pulsing or reversing the polarity of the cleaning bias V2 on the first cleaner brush 312 to V3 and the non-cleaning polarity P3. In a dual electrostatic cleaning brush environment, because the bias V2' on the second brush is already of the same polarity as that of the toner particles T1, only the cleaning bias V2 of the first cleaning brush 312 is pulsed or reversed as such. When the bias V2 of the first brush 312 is pulsed for example from a value of +450V to a value between +50 and −100V as illustrated in FIG. 4, a significant amount of negatively charged toner particles T1 on the surface 12 will move under and past the (now negatively charged) cleaner brushes 312, 314 as a lube stripe T4 to reach the spots blade 320. The lube stripe T4 is typically 5-10 mm in width by the full process width. Delivery of the lube stripe T4 to the spots blade 320 acts to lubricate the interface between the spots blade and the photoreceptor, and thus reduces the photoreceptor abrasion significantly.

The process for applying a lube stripe begins with the development of a black toner stripe of variable density onto the photoreceptor. Black was selected to be compatible with the black-only-mode of the printer. For test purposes the stripe is typically 1 cm wide by the full process width, although less than 1 cm is also very doable. In order to get the lube stripe past the dual ESB cleaner as shown schematically below, it is necessary to bias the first cleaner brush to a non-cleaning state. Nominal cleaner bias during the cleaning state is +450V. It has been found that switching the first cleaner bias to between +50 and −100V leaves sufficient toner on the photoreceptor past the cleaner brushes to effectively lubricate the photoreceptor-spots blade interface and reduce photoreceptor abrasion, thereby extending photoreceptor life.

It has also been found that the quantity of toner in the lube stripe T4 that is moved past, and hence survives a cleaning encounter with the cleaner brushes 312, 314 depends on the value of the non-cleaning bias V3 on the first brush 312. For a non-cleaning bias of 0V, it was found that about a third of the toner in the lube stripe T4 gets past both cleaner brushes.

It is necessary to switch only the bias V2, V3 of the first brush 312. The bias V2' of the second brush 314 remains at the nominal cleaning bias of −450V with a negative polarity P2'. Because the toner particles issuing from the pulsed first brush 312 are negatively charged, it was found experimentally that none of such negatively charged toner T4 were being removed from the surface 12 by the second brush 314 at −450V. Because the pulse (FIG. 4) is relatively short in duration, it was found that the amount of photoreceptor real estate that is not cleaned due to the cleaning interruption in the cleaner bias V2, V3 is only about 21 mm. Thus the lube stripe T4 will fit adequately into the space allotted to a seam zone Sz.

Thus in accordance with the present disclosure, the toner lube stripe T4 is formed within the seam zone Sz of the photoreceptor, and the interruption or pulsing of the cleaner bias V2 is interrupted momentarily only so as to allow the lube stripe T4 to get past the cleaner brushes 312, 314 when the seam area or zone Sz passes underneath such brushes.

As can be seen, there has been provided a cleaning and spots blade lubricating apparatus and method, the apparatus for the method includes (a) a pre-clean charging device including a first bias having a first polarity; (b) a cleaning device having (1) a cleaning mode including a second bias having a second polarity opposite the first polarity, and (ii) a non cleaning mode including a third bias having a third polarity; (c) a spots blade for removing random spots from a moving photoreceptor surface being cleaned; and (d) a programmable controller connected to the pre-clean charging device and to the cleaning device for forming a lubricating residual toner stripe on a portion of the moving photoreceptor surface, the programmable controller intermittently and momentarily switching the cleaning device from the cleaning mode to the non-cleaning mode for forming the lubricating residual toner stripe.

It will be appreciated that various of the above-disclosed and other features and functions of this embodiment, or alternatives thereof, may be desirably combined into other different systems or applications. Also that various presently unforeseen or unanticipated alternatives, modifications, variations or improvements therein may be subsequently made by those skilled in the art which are also intended to be encompassed by the following claims.

What is claimed is:

1. A cleaning and spots blade lubricating apparatus for use on a moving photoreceptor surface, the cleaning and spots blade lubricating apparatus comprising:

(a) a pre-clean charging device including a first bias having a first polarity for charging residual toner particles on the moving photoreceptor surface;

(b) a cleaning device for removing charged residual toner particles on the photoreceptor surface, the cleaning device having (i) a cleaning mode including a second bias having a second polarity opposite the first polarity, and (ii) a non cleaning mode including a third bias having a third polarity;

(c) a spots blade for removing random spots from the moving photoreceptor surface being cleaned; and (d) a programmable controller connected to the pre-clean charging device and to the cleaning device for intermittently and momentarily switching the cleaning device from the cleaning mode to the non-cleaning mode for repelling and leaving a lubricating toner stripe on said moving photoreceptor surface upstream of contact with said spots blade, thereby intermittently enhancing lubrication of said spots blade and preventing said spots blade from abrading and scratching said moving photoreceptor surface.

2. A cleaning and spots blade lubricating apparatus comprising:

(a) a pre-cleaning charger including a first bias having a first polarity for charging residual toner particles on a moving photoreceptor surface to said first polarity:

(b) at least one cleaning device mounted into contact with said moving photoreceptor surface and downstream of said pre-cleaning charger, said at least one cleaning device having (i) a cleaning first mode including a second bias having a second polarity opposite said first polarity for cleaning first portions of said moving photoreceptor surface by attracting and removing residual toner particles having said first polarity, and (ii) a non-cleaning second mode including a third bias having a third polarity effectively opposite said second polarity for preventing attraction and removal of residual toner particles having said first polarity from second portions of said moving photoreceptor surface;

(c) a spots blade mounted into contact with said moving photoreceptor surface and downstream of said at least one cleaning device for removing random spots from said moving photoreceptor surface; and (d) a programmable controller connected to said pre-cleaning charger and to said at least one cleaning device, said programmable controller being programmed to intermittently and momentarily switch said at least one cleaning device from said cleaning first mode to said non-cleaning second mode for repelling and leaving a lubricating toner stripe on said moving photoreceptor surface upstream of contact with said spots blade, thereby intermittently enhancing lubrication of said spots blade and preventing said spots blade from abrading and scratching said moving photoreceptor surface.

3. The cleaning and spots blade lubricating apparatus of claim 2, wherein said pre-cleaning charger comprises a corotron device.

4. The cleaning and spots blade lubricating apparatus of claim 2, wherein said first polarity is a negative polarity.

5. The cleaning and spots blade lubricating apparatus of claim 2, wherein said at least one cleaning device comprises a rotatable fiber brush.

6. The cleaning and spots blade lubricating apparatus of claim 2, wherein said second polarity is a positive polarity.

7. The cleaning and spots blade lubricating apparatus of claim 2, wherein said third polarity is effectively a negative polarity.

8. The cleaning and spots blade lubricating apparatus of claim 2, wherein said programmable controller is programmed to switch said at least one cleaning device from said cleaning first mode to said non-cleaning second mode for a period of time within a range of 100 msec to 150 msec.

9. The cleaning and spots blade lubricating apparatus of claim 2, wherein said programmable controller is programmed to switch said at least one cleaning device from said cleaning first mode to said non-cleaning second mode for a period of 125 msec.

10. A method of lubricating a spots blade of a residual toner particles cleaning apparatus, the method comprising:

(a) contacting a moving photoreceptor surface with said spots blade at a first point along a path of movement of said moving photoreceptor surface;

(b) charging residual toner particles on said photoreceptor surface to a first polarity at a second point upstream of said first point along said path of movement;

(c) operating, in a first cleaning mode, a dual mode cleaning device including a controller and a switchable dual polarity biasing source switched to a second cleaning polarity for attracting and removing charged residual toner particles from said photoreceptor surface; and (d) momentarily switching said dual polarity biasing source from said second cleaning polarity to a third non-cleaning bias and polarity for repelling and leaving a lubricating toner stripe on said moving photoreceptor surface upstream of contact with said spots blade, thereby intermittently enhancing lubrication of said spots blade and preventing said spots blade from abrading and scratching said moving photoreceptor surface.

11. The method of claim 10, wherein said operating step comprises operating said dual mode cleaning device at a third point between said first and second points along said path of movement of said moving photoreceptor surface.

12. A cleaning and spots blade lubricating apparatus comprising:

(a) a pre-clean charging device including a first bias having a first polarity for charging residual toner particles on a moving photoreceptor surface to said first polarity;

(b) a cleaning device mounted downstream of said pre-clean charging device, relative to a direction of movement of said photoreceptor surface being cleaned, said cleaning device having (i) a cleaning mode including a second bias having a second polarity opposite said first polarity for cleaning contacted portions of said moving photoreceptor surface by attracting and removing residual toner particles charged to said first polarity from said contacted portions, and (ii) a non cleaning mode including a third bias having a polarity effectively same as said first polarity for preventing attraction and hence removal of residual toner particles having said first polarity from contacted portions of said moving photoreceptor surface;

(c) a spots blade mounted into contact with said moving photoreceptor surface and downstream of said cleaning device for removing random spots from said moving photoreceptor surface; and (d) a programmable controller connected to said pre-clean charging device and to said cleaning device for forming a lubricating residual toner stripe on a portion of said moving photoreceptor surface upstream of contact with said spots blade, said programmable controller intermittently and momentarily switching said cleaning device from said cleaning mode to said non-cleaning mode for forming said lubricating residual toner stripe.

13. An electrostatographic reproduction machine comprising:

(a) a movable toner image bearing member having an image bearing surface;

(b) toner image forming devices mounted along a path of movement of said toner image bearing surface for forming a toner image on said movable toner image bearing surface;

(c) transfer means for transferring said toner image from said movable toner image bearing surface onto a substrate; and (d) a cleaning and spots blade lubricating apparatus for cleaning said moving movable toner image bearing surface, the cleaning and spots blade lubricating apparatus comprising:

(i) a pre-clean charging device including a first bias having a first polarity for charging residual toner particles on the moving movable toner image bearing surface;

(ii) a cleaning device for removing charged residual toner particles on the movable toner image bearing surface, the cleaning device having (i) a cleaning mode including a second bias having a second polarity opposite the first polarity, and (ii) a non cleaning mode including a third bias having a third polarity;

(iii) a spots blade for removing random spots from the moving movable toner image bearing surface being cleaned; and (iv) a programmable controller connected to the pre-clean charging device and to the cleaning device for intermittently and momentarily switching the cleaning device from the cleaning mode to the non-cleaning mode for repelling and leaving a lubricating toner stripe on said moving photoreceptor surface upstream of contact with said spots blade, thereby intermittently enhancing lubrication of said spots blade and preventing said spots blade from abrading and scratching said moving photoreceptor surface.

14. The electrostatographic reproduction machine of claim 13, wherein said cleaning device comprises a pair of rotatable fiber brushes.

15. The electrostatographic reproduction machine of claim 13, wherein said second polarity is a positive polarity.

16. The electrostatographic reproduction machine of claim 13, wherein said third polarity is effectively a negative polarity.

17. The electrostatographic reproduction machine of claim 13, wherein said programmable controller is programmed to switch said cleaning device from said cleaning first mode to said non-cleaning second mode for a period of time within a range of 100 msec to 150 msec.

18. The electrostatographic reproduction machine of claim 13, wherein said programmable controller is programmed to switch said at least one cleaning device from said cleaning first mode to said non-cleaning second mode for a period of 125 msec.

19. The electrostatographic reproduction machine of claim 13, wherein said pre-cleaning charging device comprises a corotron device.

20. The electrostatographic reproduction machine of claim 13, wherein said first polarity is a negative polarity.

* * * * *